US005457902A

United States Patent [19]

Rubin

[11] Patent Number: 5,457,902

[45] Date of Patent: Oct. 17, 1995

[54] LIFE EVENT CHRONOLOGER

[76] Inventor: Gary V. Rubin, 9403 N. Neenah, Morton Grove, Ill. 60053

[21] Appl. No.: 977,068

[22] Filed: Nov. 16, 1992

[51] Int. Cl.[6] ..... G09D 3/00

[52] U.S. Cl. ..... 40/107; 283/2

[58] Field of Search ..... 40/110, 122, 124.4, 40/124.2, 107, 111; 283/2; 229/93; D19/20, 21, 22, 23, 24, 25

[56] References Cited

U.S. PATENT DOCUMENTS

| | | | |
|---|---|---|---|
| D. 43,708 | 3/1913 | Weeks | D19/20 |
| D. 163,586 | 6/1951 | Dingeldein | D19/21 |
| D. 214,768 | 7/1969 | Hillis | D19/23 |
| D. 217,040 | 3/1970 | Smith | D19/23 |
| D. 254,853 | 4/1980 | Grunstad | D19/23 |
| 2,215,705 | 9/1940 | Lenz | 229/93 |
| 2,222,366 | 11/1940 | Glass | 229/93 |
| 2,400,268 | 5/1946 | Skene | 40/111 |
| 4,203,521 | 5/1980 | Dunn | 229/93 |

*Primary Examiner*—Clifford D. Crowder
*Assistant Examiner*—Gloria Hale
*Attorney, Agent, or Firm*—Patula & Associates

[57] ABSTRACT

A device for recording and displaying events, occurrences, achievements, and milestones in a person's life. The device consists of a base, a tubular section, and a top section. The tubular section spirals upward from the base making five complete spirals. Each complete spiral represents a one year period. At the beginning of each complete spiral, a slot is provided from the insertion of a paper or cardboard tab. The events, occurrences, achievements, and milestones and their dates are recorded on the tabs which are then inserted into the slots. When each of the five complete spirals have received a tab, the top section is removed and an additional tubular section is added. The device allows the events of a person's life to be displayed all at the same time in an organized way without taking up a large space.

22 Claims, 1 Drawing Sheet

LIFE EVENT CHRONOLOGER

This invention teaches a novel device for recording and displaying special events, milestones, and achievements in a persons life.

BACKGROUND OF THE INVENTION

It has long been a practice of many people and families to record certain events or occurrences in their lives so that they may reminisce about these events either alone or with others. Recording such life events can be done in many ways such as using photo albums or keeping diaries. Others may save letters, postcards, calendars, or other documents that symbolize or stand as a reminder of certain special events.

While some of these methods are adequate for recording and displaying some life events, there are many problems that occur in the recording and displaying of these events using some of these methods. For example, problems arise using photo albums in that throughout a persons life, many events occur where there are no cameras present and the life event is not captured on film. Further, the events that are captured accumulate to the point where there are so many photo albums, they become cumbersome and difficult to store. Also, a great amount of time is consumed looking through all of the albums. Another problem with photo albums is that many of the pictures become lost of damaged over the years or people will forget or will not know what event the photo symbolizes.

Problems arise in the use of diaries in that diaries are usually private and are not meant to be displayed. Further, a person cannot keep a diary until they are able to write and know the language well, thereby being unable to record a very special period in one's life. Also, diaries tend to be long and record both good and bad life events or even average or trivial events.

The method of saving various documents has numerous disadvantages such as storage problems, displaying problems, and problems with losing the documents. Further, many life events do not produce tangible evidence of its occurrence, such as a babies first word or almost any other unexpected event.

The present invention solves the problems of recording and displaying special or important events or occurrences in one's life. The invention allows easy recording of chronological events throughout a person's life and displays all these events in one place, all at the same time. Further, the novel design of the invention allows all the life events to be displayed in a limited space and the invention may be left for example on the top of a desk or piece of furniture, thereby eliminating the need for storage. Also, the invention is simple in construction and use and therefore provides an inexpensive and easy method of recording and displaying the special events, milestones, achievements, or occurrences in a persons life.

BRIEF SUMMARY OF THE INVENTION

The invention consists of a base having a number of stabilizing legs. Attached to the base is a tubular section comprised of a five year spiral. Located at the beginning of each year of the five year spiral, along an edge of the tubular section, is an opening or slot. A paper or cardboard tab can be inserted into each slot. On the paper or cardboard tab, the life event and the date it occurred is recorded. Colorful stickers having pre-printed dates or pre-printed events that are sure to occur at some point in time, may be used to record the life events.

Additional tubular sections of five year spirals can be added onto the tubular section attached to the base as the person ages. Each additional tubular section snaps onto and is securely fastened to the previous tubular section. Attached to the top of the last added tubular section is a top module. The top module snaps onto and is secured to the last added tubular section. The top section is formed in the shape of a cube and can be used to display photos.

It is the principle object of the present invention to provide means for recording and displaying special events, milestones, achievements, or occurrences in a person's life.

It is a further object of the invention to provide an aesthetic device that allows for easy recording of life events.

It is also an object of the invention to provide an aesthetic device that displays all of the life events at the same time.

It is an additional object of the invention to teach a simple and novel method of recording and displaying special events in a person's life.

It is another object of the present invention to provide a device that expands to allow for more recording of chronological events as a person ages, without the need for storage space.

It is yet another object of the invention to teach a novel means for recording and displaying life events that is efficient and inexpensive.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT OF THE PRESENT INVENTION

Figure 1:
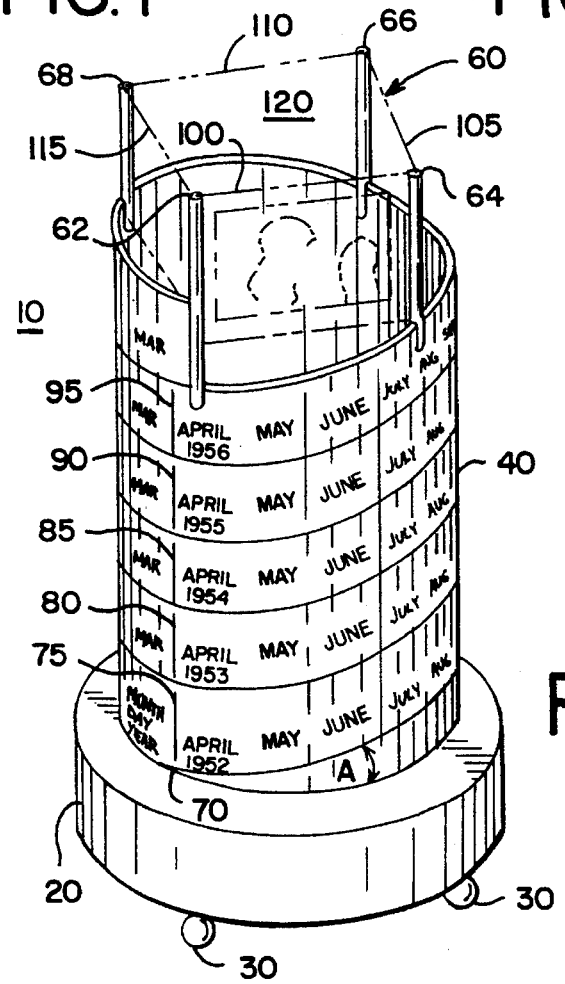
FIG. 1 is a perspective view of the preferred embodiment of the present invention.

While the invention is susceptible of embodiment in many different forms there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

FIGS. 1–4 illustrate the present invention 10 comprising base 20, base support members 30, a first five year spiral tubular section 40, additional five year spiral tubular section 50, and top module 60.

Base 20 is preferably circular but may be formed in any desired shape such as square or hexagonal. Further, the base may be constructed from any suitable material but is preferably made of hard plastic or metal. Attached to the bottom of the base 20 are base support members 30. Base members 30 are illustrated as three spherical legs spaced at equal distances around the outer perimeter of the base 20 to provide suitable support for invention 10. However, it is contemplated that the base members 30 may be any suitably shaped legs and may consist of three or more equally spaced support members.

Attached to the top of base 20 is first five year spiral tubular section 40. The tubular sections of the invention are made from a see-through material such as clear, hard plastic. The base 20 is wider than tubular section 40. Starting from starting point 70, tubular section 40 spirals upwards at an angle A, making five complete spirals. Each complete spiral represents a one year time period. At the beginning of each one year spiral on tubular section 40 is a slot which allows for the insertion of a paper or cardboard tab 43 (see FIG. 5). Onto each paper or cardboard tab are recorded certain events or occurrences of importance in a person's life. The dates and/or occurrences may also be in the form of pre-printed stickers which are placed on the paper or cardboard tab before insertion. The see-through material of the tubular sections allow the information placed on the tabs to be seen and read. Since all the information is placed on the cardboard tabs, nothing need be written or draw on the plastic tubular sections, thereby allowing these sections to be re-used or interchanged if necessary.

As a person ages, additional five year spiral tubular sections 50 may be added to the first five year spiral tubular section 40. Additional tubular sections 50 snap onto the top of the previous tubular section. The bottom of additional tubular section 50 spirals upwards in the same manner as first tubular section 40. Again, additional tubular section 50 makes five complete spirals. Each complete spiral represents a one year time period. At the beginning of each spiral on additional tubular section 50, a slot is provided for the insertion of a paper or cardboard tab for recording life events.

Top section 60 snaps onto the last tubular section in use on the invention 10. Top section 60 comprises connecting posts 62, 64, 66, and 68 which connect to the top of the last tubular section in use. Top section 60 also comprises four sides 100, 105, 110, and 115 and a top 120. Each of the four sides 100–115 and top 120 can be used to display photographs. In order for the top section 60 to be level with the base 20, connecting posts 62–68 must be of different lengths due to the upward spiraling of the tubular sections. Connecting post 62 is longer than post 64 which is longer than post 66 which is longer than post 68.

Figure 2:
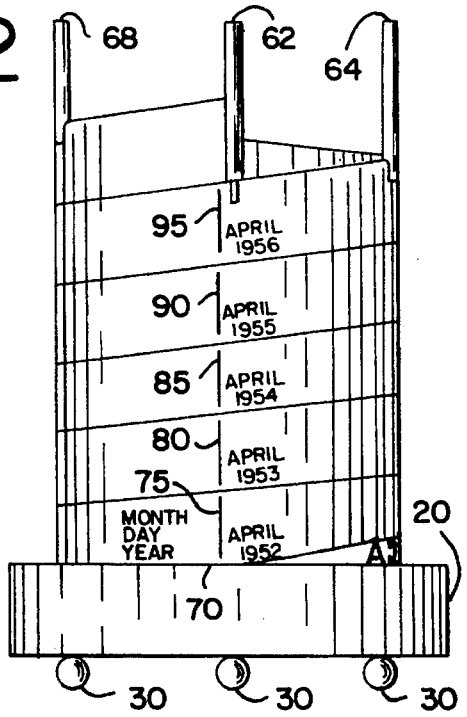
FIG. 2 is a side view of the present invention.
Figure 4:
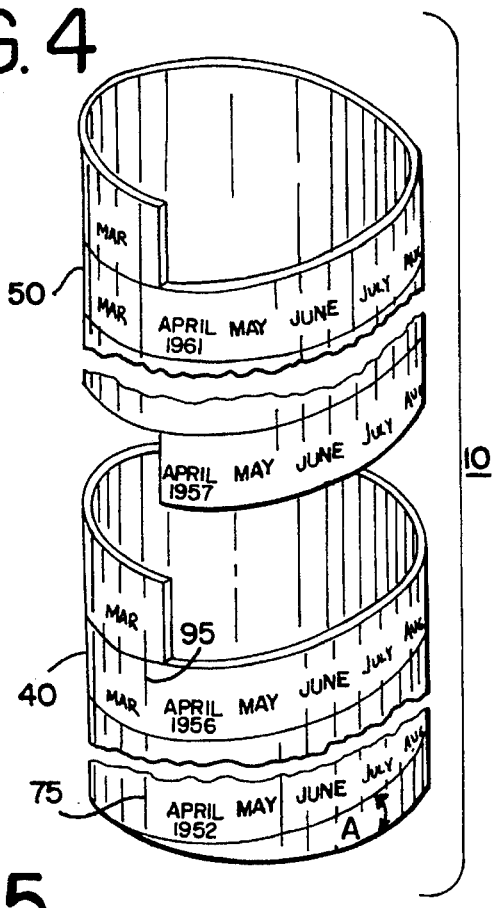
FIG. 4 is a exploded perspective view of two partially broken away tubular sections of five year spirals of the present invention.

FIG. 1 shows invention 10 comprising circular base 20, base support members 30, first five year spiral tubular section 40, and top section 60 attached to tubular section 40. On one side of the base 20 is written or engraved the logo "The Life Spiral." The opposite side of the base contains a space for a persons name to be written or engraved. First tubular section 40 begins to spiral upwards at point 70 at an angle A and makes five complete spirals. Each spiral—, defined as that portion of the tubular section beginning from one slot and spiraling upward to the next slot and defined by top and bottom spiral dividing lines (as seen in FIGS. 1, 2 and 4),— represents a one year time period. Means for recording and displaying the occurrences in a person's life are provided on the tubular section 40. Such means can include, but are not limited to, slots on the tubular section which cooperate with tab elements. Such means can also include any equivalent structure which cooperates with the tubular section and functions to indicate position along the spiral. Therefore, each tubular section comprises five complete spirals or a five year spiral. At the beginning of the first one year spiral, is slot 75. Slot 75 allows for the insertion of a paper or cardboard tab onto which will be recorded the first year of life events of a person. The tab will be of a length so that, when completely inserted, it will end at the beginning of the next one year spiral or at slot 80.

Slot 80 marks the beginning of the second one year spiral of first tubular member 40. A tab full of recorded life events for the second year of a person's life is inserted into slot 80. This tab ends at the beginning of the next one year spiral (the third spiral). Similarly, at the beginning of the third, fourth and fifth one year spirals, slots 85, 90 and 95, respectively, are provided for the insertion of paper or cardboard tabs.

Attached to the top of first tubular section 40 is top section 60 having connecting posts 62–68, four sides 100–115, and top 120. The top section 60 may also contain the logo "The Life Spiral." Further, top section 60 is designed to hold 5 photographs that a person wishes to display.

FIG. 2 shows a side view of invention 10. Affixed to the bottom of base 20 are three spherical base support members 30. Affixed to the top of base 20 is the first five year spiral tubular section 40. At starting point 70, tubular section 40 spirals upward making five complete spirals. Each complete spiral represents a one year period. At the beginning of the first, second, third, fourth and fifth spirals, a slot 75, 80, 85, 90 and 95, respectively, is provided to allow for the insertion of a paper or cardboard tab onto which is recorded certain life events in a person's life. Also shown are connecting posts 62, 64, and 68.

Figure 3:
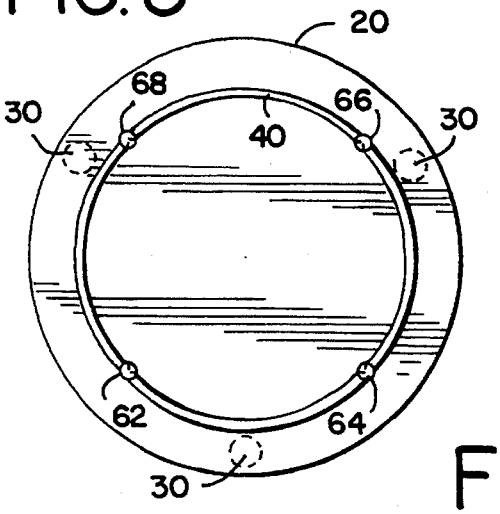
FIG. 3 is a top view of the present invention.

FIG. 3 shows a top view of invention 10 having base 20, base support members 30, first five year spiral tubular section 40, and connecting posts 62–68.

FIG. 4 shows first five year spiral tubular section 40 and an additional five year spiral section 50 in position to be snapped onto first tubular section 40. Additional five year spiral sections may be added onto each previous additional five year section as a person ages.

Figure 5:
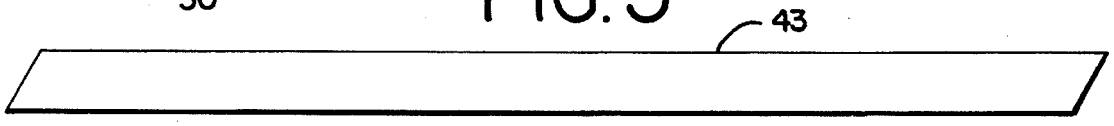
FIG. 5 is a front view of a cardboard or paper tab of the present invention.

FIG. 5 shows a cardboard or paper tab 43 which is inserted into the slots 75–95 on invention 10. Life events are recorded thereon.

In operation, and by way of illustration only, a parent receives the invention 10 as a present for a new born baby. The top section 60 is attached to the first five year spiral tubular section 40 as shown in FIG. 1. The new born baby's name is then written or engraved onto the base 20. As the baby grows, the baby's life events and the dates of occurrence are recorded on paper or cardboard tabs. These tabs are then inserted into the slots 75–95, one for each year. Pre-printed colorful stickers may be placed on the paper or cardboard tabs to give the invention 10 a more aesthetic appearance. For example, the pre-printed stickers may include the phrases "baby's first step" or "turned 3 years old."

When the child turns or nears the age of five, an additional five year spiral tubular section must be added. The top section 60 is removed from tubular section 40. Additional tubular section 50 is then snapped onto first tubular section 40. The top section 60 is then attached to additional tubular section 50. Life events continue to be recorded onto paper or cardboard tabs and inserted into their corresponding slots in the tubular members. Again, pre-printed stickers such as "started kindergarten" or "turned 9 years old" may be used.

As the person continues to age, every five years, additional five year spiral tubular sections are added in the manner previously described. Photographs stored in the top section 60 may also be repeatedly changed as the person grows.

It has been shown and described a novel method and device for recording and displaying special life events in a person's life. The invention 10 can be used by persons of all ages. For example, a forty year old may obtain the invention 10 and the appropriate number of additional five year spiral tubular sections, and record as many special past life events and the dates they occurred as can be remembered. Then as the person continues to age, new life events can be recorded and displayed. The invention 10 can have great sentimental value, not only to the person who's life events are recorded, but also to other family members and persons interested in the life of that individual.

It is to be understood that the embodiments herein described are merely illustrative of the principles of the present invention. Various modifications may be made by those skilled in the art without departing from the spirit or scope of the claims which follow.

I claim:

1. A device for recording and displaying occurrences in a person's life, said device comprising:

a base having support means for supporting the base;

a tubular section attached to said base;

means for recording and displaying the occurrences in a person's life on said tubular section; and a top section connected to said tubular section.

2. The device of claim 1, wherein said tubular section comprises a set of sequential indicia corresponding to the passage of time.

3. The device of claim 1, wherein said support means are three spherical legs spaced apart at equal distances.

4. The device of claim 2, wherein said set of sequential indicia of said tubular section begins to spiral upwards starting at a point on said base and makes five complete spirals.

5. The device of claim 4, wherein each spiral of said five complete spirals represents a one year time period.

6. The device of claim 5, wherein said means for recording further comprises slots in said tubular section located at a beginning of each of said five complete spirals.

7. The device of claim 6, wherein said slots allow for the insertion of said means for recording said occurrences in a person's life.

8. The device of claim 7, wherein said means for recording is a paper tab.

9. The device of claim 7, wherein said means for recording is a cardboard tab.

10. The device of claim 4, wherein said top section snaps onto and is removable from said tubular section, and when said top section is removed from said tubular section, additional sets of sequential indicia corresponding to the passage of time are selectively connected to said tubular section.

11. The device of claim 1, wherein said top section comprises four sides and a top for receiving photographs.

12. A device for recording and displaying events, occurrences, achievements, and milestones in a person's life, said device comprising:

a base having a plurality of equally spaced support members;

a tubular section comprising a set of sequential indicia corresponding to the passage of time attached to said base;

a plurality of additional substantially similar tubular sections removably attachable to said tubular section comprising a set of sequential indicia;

a top section having a plurality of connecting posts, a plurality of sides, and a top; and means for recording and displaying said events, occurrences, achievements, and milestones in a person's life on said tubular sections.

13. The device of claim 12, wherein said set of sequential indicia of said tubular section and said additional tubular sections are comprised of spirals which spiral upwards and make five complete spirals.

14. The device of claim 13, wherein each of said five complete spirals represents a one year period.

15. The device of claim 14, wherein said tubular section and said additional tubular sections contain slots at a beginning of each of said five complete spirals to allow for the insertion of said means for recording.

16. The device of claim 12, wherein said means for recording and displaying is a paper tab.

17. The device of claim 12, wherein said means for recording and displaying is cardboard tab.

18. The device of claim 12 wherein said sides and said top of said top section receive and display photographs.

19. The device of claim 12, wherein said connecting posts of said top section are removably secured to said tubular section.

20. The device of claim 19, wherein when said top is removed from said tubular section, said additional tubular sections can be connected to said tubular section, and said top connected to said additional tubular sections.

21. A method of recording and displaying occurrences in a person's life using a device consisting of a base having support members, a first tubular section comprising a set of sequential indicia corresponding to the passage of time, a plurality of additional substantially similar tubular sections, and a top section, and a plurality of recording tabs, said method comprising the steps of:

attaching said top section to said first tubular section;

placing photographs in said top section;

recording occurrences and dates of said occurrences on one of said recording tabs;

inserting said one of said recording tabs into a slot in said tubular member;

detaching said top section from said first tubular section when said first tubular section receives a capacity of said recording tabs;

attaching an additional tubular section to said first tubular section;

attaching said top section to said additional tubular section;

repeating the steps of recording and inserting; and repeating the steps of detaching and attaching.

22. A device for recording and displaying occurrences in a person's life, said device comprising:

a base having support means for supporting the base;

a tubular section attached to said base;

means, cooperating with said tubular section, for recording and displaying the occurrences in a person's life on said tubular section; and a top section connected to said tubular section.

* * * * *